US005767627A

United States Patent [19]

Siniaguine

[11] Patent Number: 5,767,627

[45] Date of Patent: Jun. 16, 1998

[54] PLASMA GENERATION AND PLASMA PROCESSING OF MATERIALS

[75] Inventor: Oleg Siniaguine, Oxford, Conn.

[73] Assignee: TruSi Technologies, LLC, Sunnyvale, Calif.

[21] Appl. No.: 781,568

[22] Filed: Jan. 9, 1997

[51] Int. Cl.[6] ..... H01J 7/24

[52] U.S. Cl. ..... 315/111.41; 315/111.21; 219/121.52; 219/121.36; 219/123

[58] Field of Search ..... 315/111.41, 111.21, 315/111.51; 219/121.11, 121.41, 121.44, 121.52, 122, 123, 121.36; 204/280, 298.2, 298.22; 376/121, 141, 144; 156/345; 313/231.01, 231.31

[56] References Cited

U.S. PATENT DOCUMENTS

| | | | |
|---|---|---|---|
| 3,283,205 | 11/1966 | DeBolt | 315/111 |
| 3,476,907 | 11/1969 | Foex et al. | 219/121 |
| 3,594,609 | 7/1971 | Vas | 315/111 |
| 4,013,867 | 3/1977 | Fey | 219/121 P |
| 5,369,336 | 11/1994 | Koinuma et al. | 315/111.21 |
| 5,474,642 | 12/1995 | Zorina et al. | 156/345 |
| 5,680,014 | 10/1997 | Miyamoto et al. | 315/111.41 |

FOREIGN PATENT DOCUMENTS

| | | |
|---|---|---|
| WO 93/16573 | 8/1993 | European Pat. Off. . |
| 2032281 | 3/1995 | Russian Federation . |
| WO 92/12273 | 7/1992 | WIPO . |
| WO 92/12610 | 7/1992 | WIPO . |
| WO 96/21943 | 7/1996 | WIPO . |
| WO 96/23394 | 8/1996 | WIPO . |
| WO 96/32742 | 10/1996 | WIPO . |

OTHER PUBLICATIONS

Agrikov, Yu. M., et al., "Osnovy Realizatsii Metoda Dinamicheskoy Plaszmennoy Obrabotki Poverhnosti Tverdogo Tela", Institut Neftehimicheskogo Sinteza im. A.V. Topchieva, Plazmohimiya–87 (USSR, 1987), Part 2, pp. 58–96.

Kulik, P.P., "Dinamicheskaya Plazmennaya Obrabotka (DPO) Poverhnosti Tverdogo Tela", Institut Neftehimicheskogo Sinteza im. A.V. Topchieva, Plazmohimiya–87 (USSR, 1987), Part 2, pp. 4–13.

Budnik, O. Yu., et al., "Apparatura Monitoringa Plazmennogo Potoka", Nauchno–Proizvodstvennoe Ob'edinenie ROTOR, Oborudovanie Dlya Vysokoeffectivtnyh Tehnologiy, Nauchnye Trudy (Cherkassy, 1990), vol. 1, pp. 72–78.

*Primary Examiner*—Benny Lee
*Assistant Examiner*—Haissa Philogene
*Attorney, Agent, or Firm*—Skjerven, Morrill, MacPherson, Franklin & Friel; Michael Shenker

[57] ABSTRACT

A plasma generation system includes one or more pairs of electrode units. Each electrode unit emits a plasma carrying gas along a respective axis. Each pair of electrode units is connected to an electric power supply that creates an electric discharge through the gas jets emitted by the two units. The axes of the two units define a "basic" plane. Each unit is associated with a magnetic circuit having two poles on the opposite sides of the basic plane. Each of these circuits is used to move the plasma gas jet emitted by the respective unit towards or away from the plasma jet emitted by the other unit of the pair of units. Therefore, these circuits control the angle at which the plasma jets meet. In addition, for each pair of the electrode units, a three-pole magnetic circuit is provided to move the plasma jets perpendicularly to the basic plane. The three poles of the magnetic circuit extend substantially along the basic plane. The three poles include a "first" pole, a "second" pole, and "middle" pole between the first and second poles. One of the plasma jets is controlled by the magnetic field passing through the first and middle poles, and the other plasma jet is controlled by the magnetic field passing through the second and middle poles.

20 Claims, 7 Drawing Sheets

PLASMA GENERATION AND PLASMA PROCESSING OF MATERIALS

BACKGROUND OF THE INVENTION

The present invention relates to plasma generation and plasma processing of materials,and more particularly to plasma generation and processing systems in which plasma flow is controlled by a magnetic field.

Plasma processing has been widely used to deposit or etch various materials. An exemplary plasma processing system is described in Russian patent 2032281 (Mar. 27, 1995) of inventors O. V. Siniaguine and I. M. Tokmulin. In that system,two or four electrode units emit jets of plasma carrying gas. The jets carry electric current. The direction of the jets is controlled by forces generated by interaction of this current with magnetic fields created by the system.

The magnetic fields are created as follows. For each electrode unit, a separate magnetic circuit is provided to control the direction of the plasma jet emitted by the unit. The magnetic circuit has three magnetic fields directed along the three sides of the triangle formed by the poles. One of these three magnetic fields is used to move the respective plasma jet (plasma jet "PJ1") towards or away from a plasma jet emitted by another electrode unit (plasma jet "PJ2"). The other two magnetic fields of the triangle control the positioning of the plasma jet PJ1 along an axis perpendicular to the plane containing the plasma jets PJ1, PJ2.

It is desirable to provide a simpler and more flexible plasma flow control in plasma generators and plasma processing system.

SUMMARY

The present invention provides, in some embodiments, plasma generators and plasma processing systems in which the plasma flow control is simple and flexible. More particularly, the inventor has observed that the plasma flow control described in the above Russian patent 2032281 is limited because of the interdependence of the three magnetic fields generated by each magnetic circuit. The fields are interdependent because each magnetic pole affects the fields along two sides of the triangle formed by the poles. More particularly, in the system of the Russian patent each magnetic circuit has an electric coil which is positioned so that the magnitude of the magnetic field used to move the plasma jet PJ1 towards or away from plasma jet PJ2 limits the other two magnetic fields generated by the circuit. Further, determining the proper current in the magnetic circuits' coils is complicated by the fact that the current in one coil affects different magnetic fields which control motion of a plasma jet in different directions. A further limitation is that the angle between the plasma jets must be less than 90°. This limitation arises because the magnetic field used to move the plasma jet PJ1 towards or away from plasma jet PJ2 is directed to move the plasma jet PJ1 towards PJ2. Therefore, to enable plasma jet PJ1 to be moved away from PJ2, the two plasma jets are directed at an angle less than 90°to each other so that the magnetic fields generated by the plasma jets themselves pull the plasma jets away from each other. The requirement of the angle being less than 90° is an undesirable limitation on the plasma flow configuration and possible applications.

A plasma generation system described in PCT application WO 92/12610, published Jul. 23, 1992, has similar limitations but the angle between the plasma jets in that system must be greater than 90°.

In some embodiment of the present invention, these limitations are removed. The magnetic fields used to move plasma jets towards or away from each other are independent from the magnetic fields used to move plasma jets in a perpendicular direction. Therefore, a greater control over the plasma flow is provided.

Further, in some embodiments, the magnetic system automatically ensures that when the two plasma jets move, the two plasma jets do not diverge from one another but continue to meet. If the plasma jets diverged, the voltage needed to maintain the electric discharge generating the plasma would undesirably increase because the discharge current flows through the two plasma jets.

These advantages are achieved in some embodiments as follows. A system is provided that includes one or more pairs of electrode units. Each electrode unit emits a plasma flow (a plasma jet) along a predetermined axis. For each pair of electrode units, the corresponding two axes define a plane passing through these axes. We will call this plane a "basic" plane. For each pair of electrode units, two magnetic circuits move the respective two plasma jets towards or away from each other in a direction parallel to the basic plane. A third magnetic circuit moves both plasma jets in a direction perpendicular to the basic plane. This latter magnetic circuit has three legs—a "first" leg, a "second" leg, and a "middle" leg between the first and second legs. Each leg is an extension that ends in a pole. For ease of reference, we will call the poles at the end of the first, second and middle legs a "first" pole, a "second" pole, and a "middle" pole respectively. One of the two plasma jets is controlled by a magnetic field passing through the first pole and the middle pole. The other plasma jet is controlled by a magnetic field passing through the second pole and the middle pole. These two magnetic fields are generated using an electrical coil wound around the middle leg, and are equal in magnitude. Therefore, the resulting forces acting on the two plasma jets are equal. Consequently, both plasma jets deviate from the basic plane in the same direction and by the same amount (which can be zero). Hence, the two plasma jets continue to meet and do not diverge.

In some embodiments, an additional coil is provided on the first or second leg to compensate for any possible asymmetry between the two plasma jets. In some embodiments, the coil on the middle leg is omitted and replaced by two coils on the respective first and second legs. In some embodiments, each of the two coils has the same number of turns, and the currents in the two coils are equal to each other, or have a predetermined offset, to cause the two plasma jets to meet.

The two magnetic fields generated by the three-pole magnetic circuit are controlled independently from the fields moving the plasma jets towards or away from each other. Therefore, plasma flow control is flexible and simple.

Other features and advantages of the invention are described below. The invention is defined by the appended claims.

Figure 6:
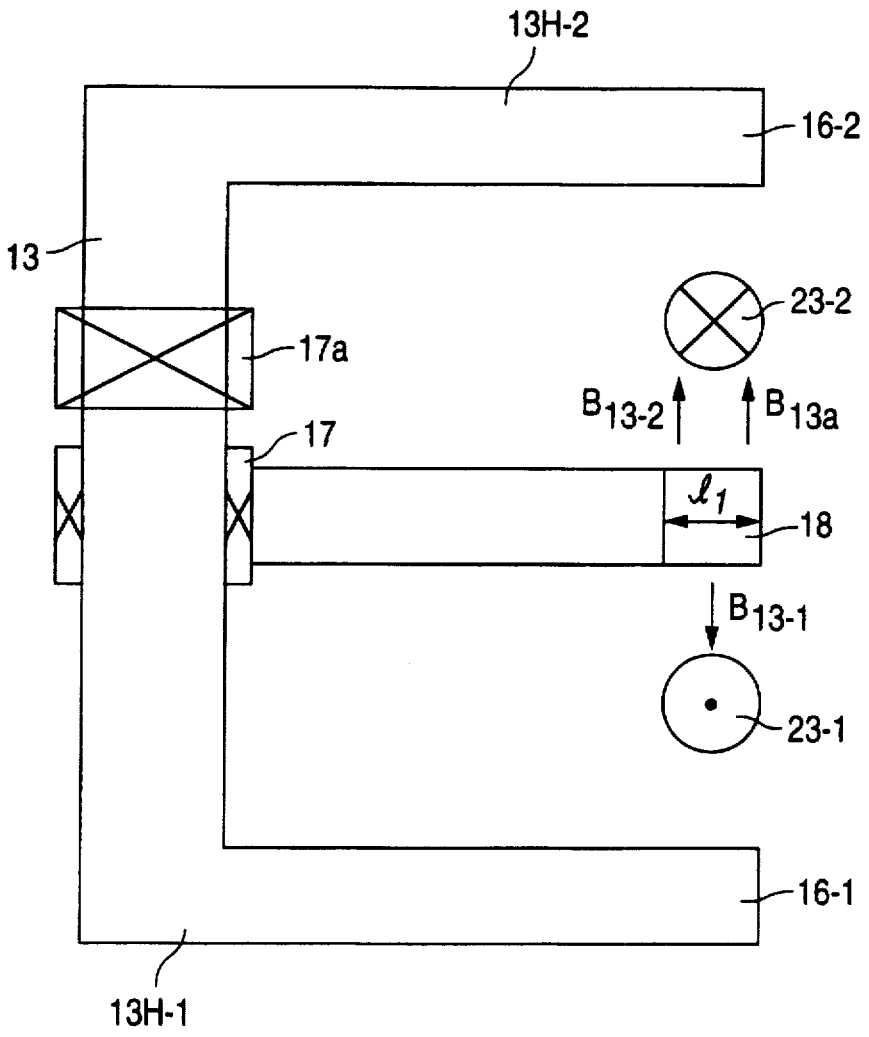
Figure 7:
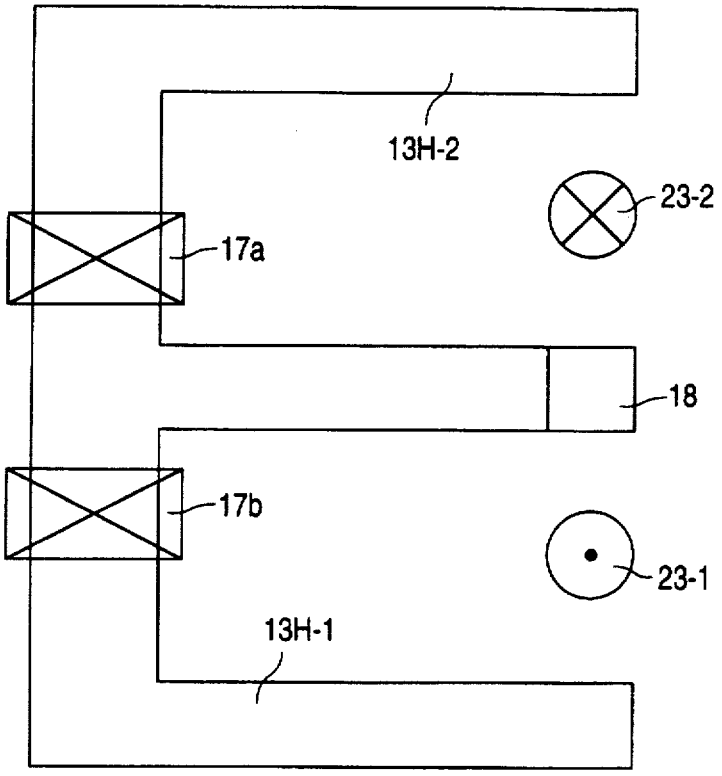
Figure 8:
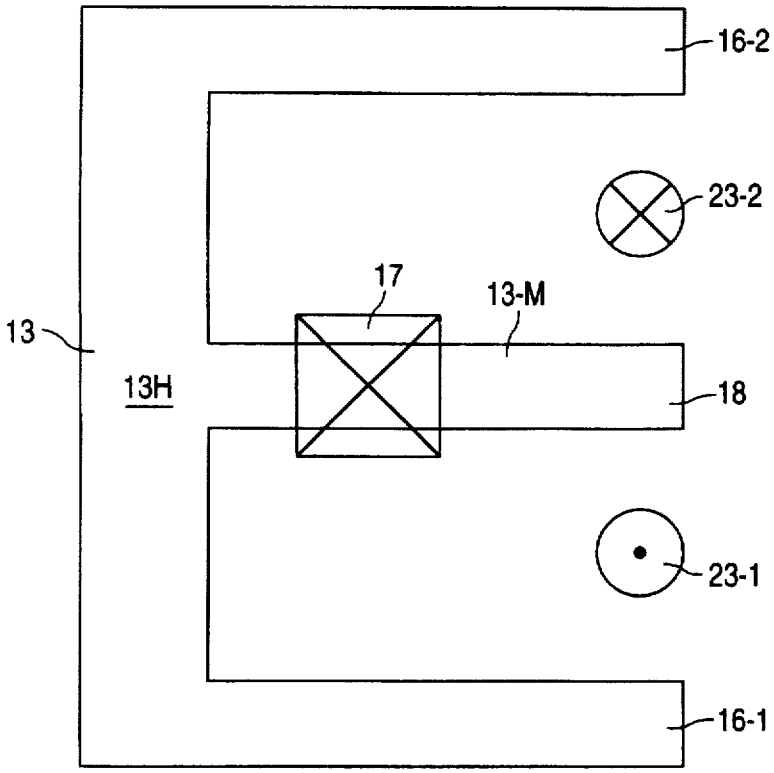

Each of FIGS. 6–8 is a bottom view of a portion of a magnetic system of a plasma generator according to the present invention.

DESCRIPTION OF PREFERRED EMBODIMENTS

Figure 1:
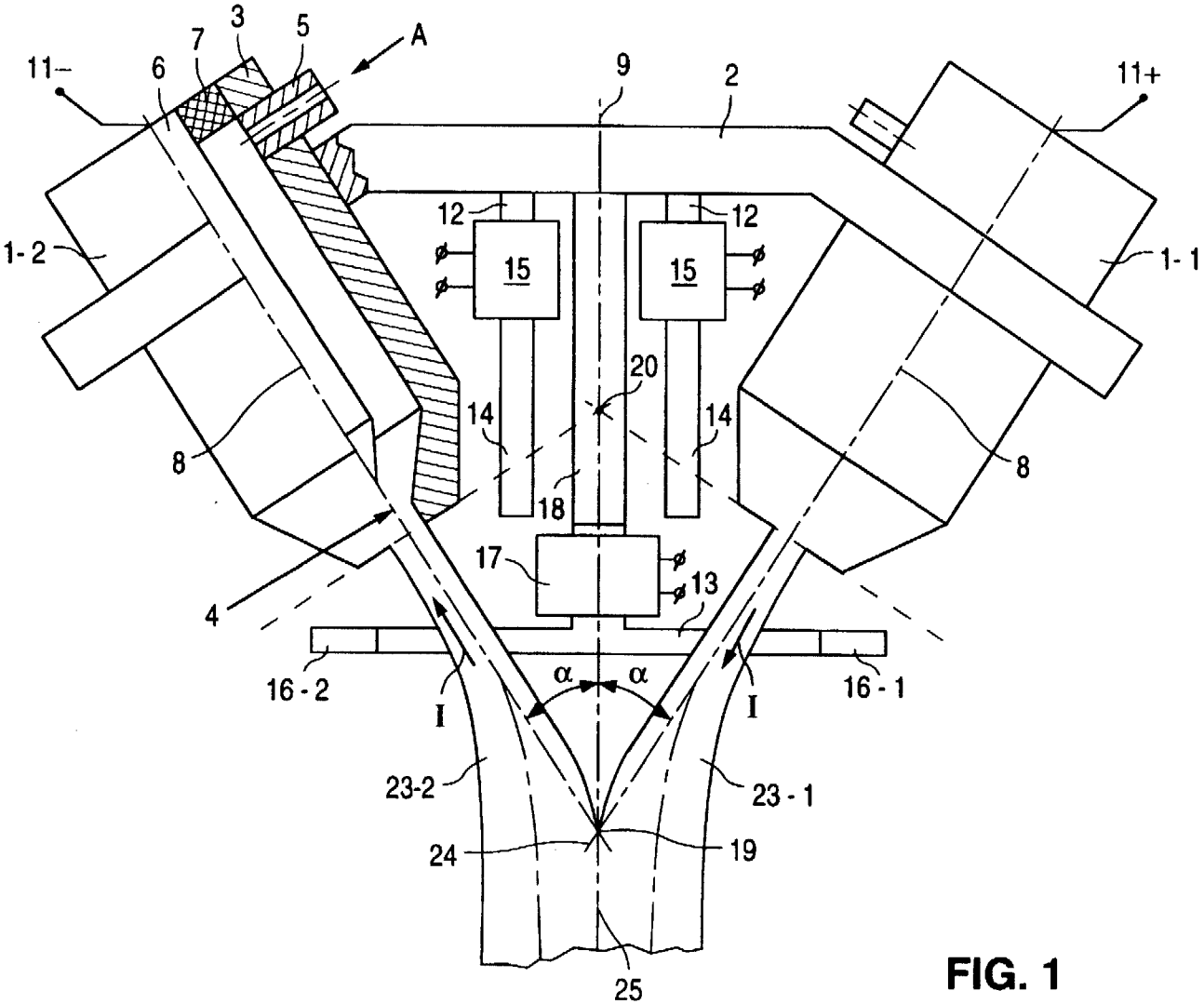
FIG. 1 is a front view of a plasma generator according to the present invention.
Figure 2:
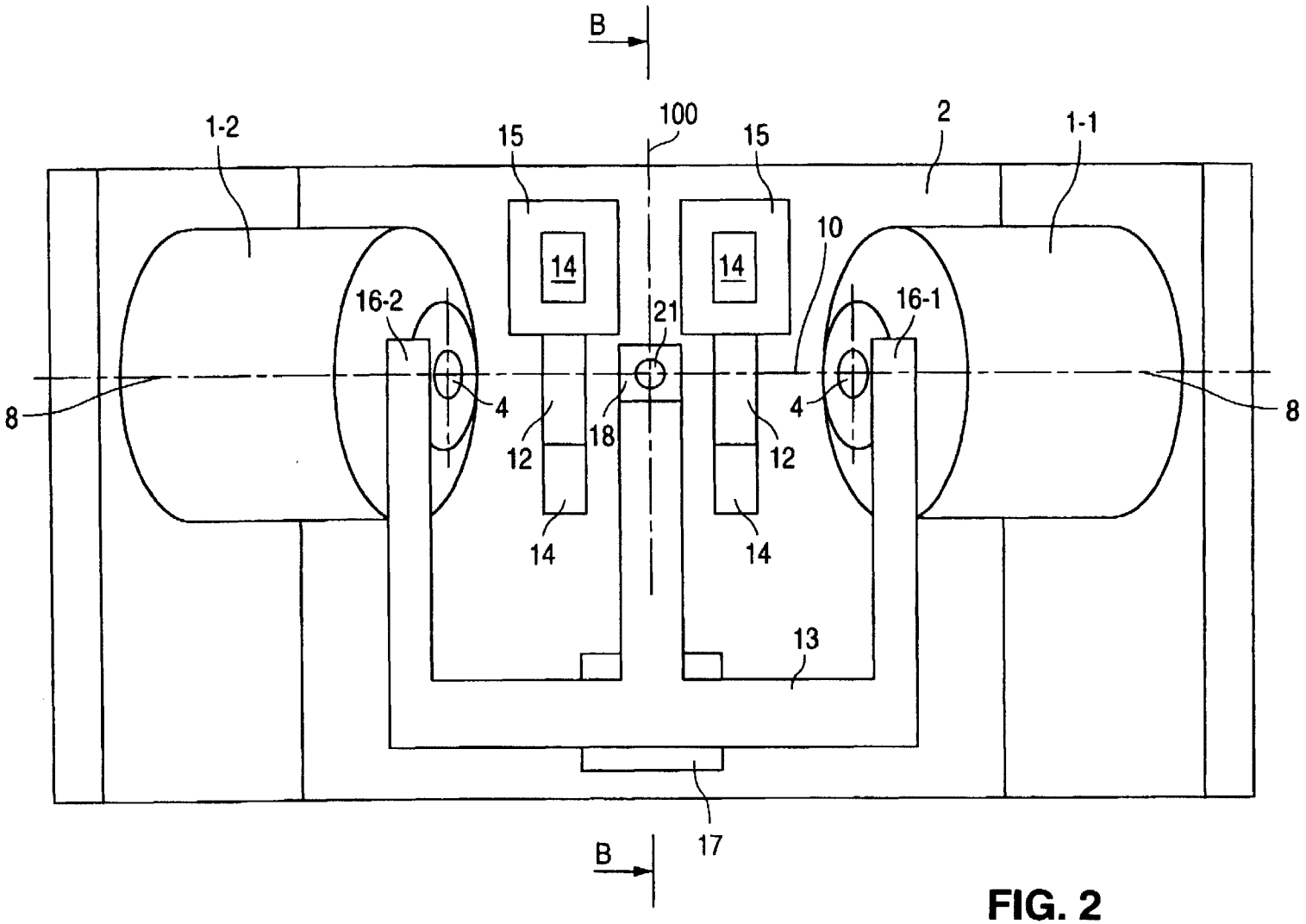
FIG. 2 is a bottom view of the plasma generator of FIG. 1.
Figure 3:
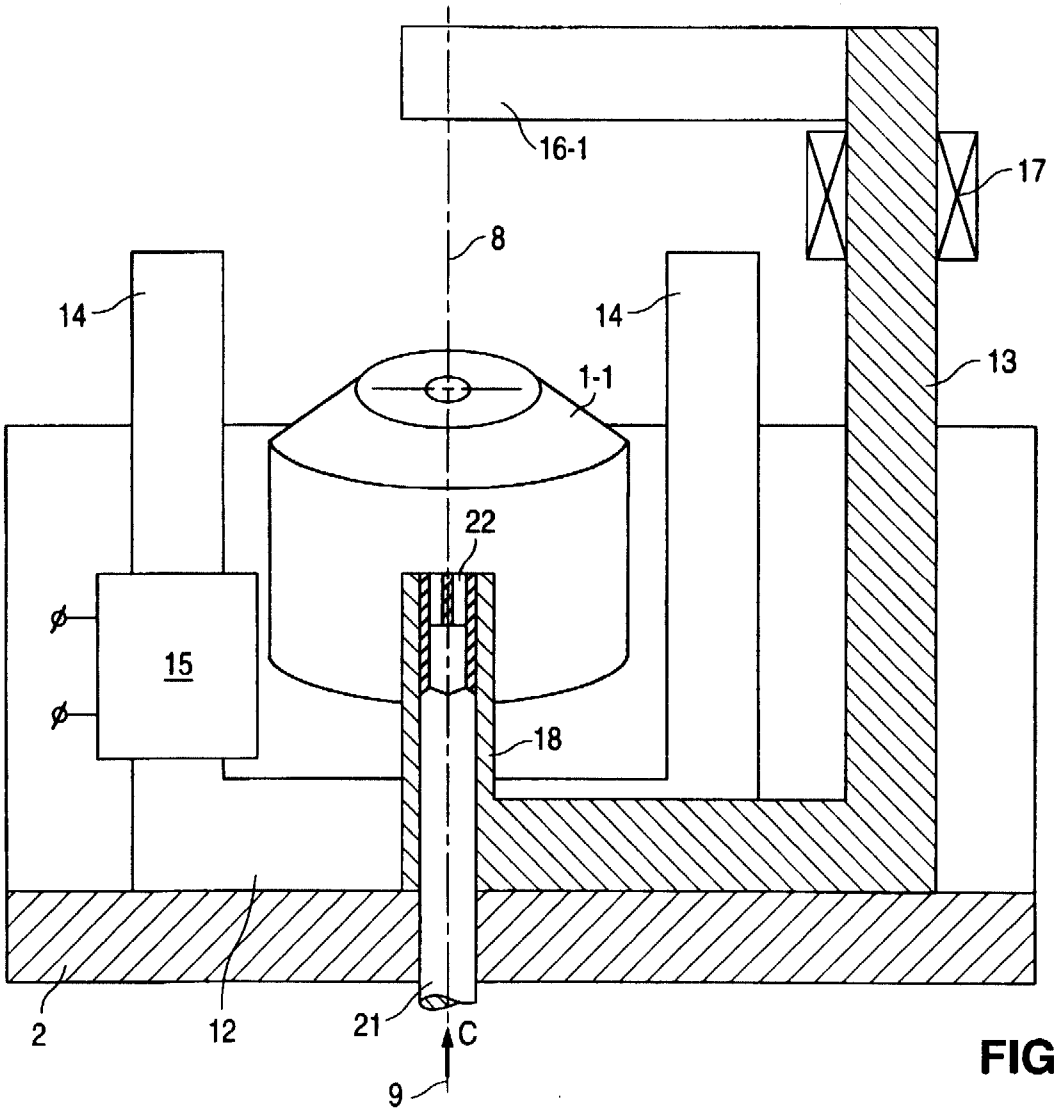
FIG. 3 is a cross-section along the line B—B of the plasma generator as shown in FIG. 2.

FIGS. 1–3 show a plasma generator having two identical electrode units 1-1, 1-2 affixed to a base 2. Every electrode unit 1 (i.e., every unit 1-1, 1-2) includes electrically isolated closed chamber 3 with outlet orifice 4, gas inlet 5 and electrode 6 fixed in dielectric gasket 7. The electrode 6 is placed inside the chamber 3. The ends of electrode 6 and the outlet orifice 4 are located on electrode unit axis 8. Gas flows into the electrode unit 1–2 in the direction of arrow A, and is emitted along the unit axis 8. In unit 1-1, the gas flow is similar.

Electrode units 1 are placed around the plasma generator's axis 9. Outlet orifices 4 are directed towards the plasma generator axis 9. The units' axes 8 intersect the plasma generator axis 9 at an angle α. In some embodiments, the angle α is less than 90°. Unit axes 8 lie in a "basic" plane 10. plasma generator axis 9 lies in the basic plane.

The electrodes 6 of electrode units 1 are connected to DC power supply 11. DC power supply 11 maintains arc discharge in gas jets 23–1, 23–2 emitted by the units. The discharge current flows from the positive terminal of power supply 11 through the electrode (not shown) of unit 1-1, through gas flow (gas jet) 23-1 emitted by unit 1-1, gas jet 23-2 emitted by unit 1-2, electrode 6 of unit 1-2, to the negative terminal of power supply 11. Similar electrode units and plasma flow are described in PCT application WO 92/12273 published Jul. 23, 1992 and entitled "Method and Device for plasma processing of Material", and in Russian patent 2032281 (Mar. 27, 1995). The PCT application and the Russian patent are incorporated herein by reference.

Figure 4:
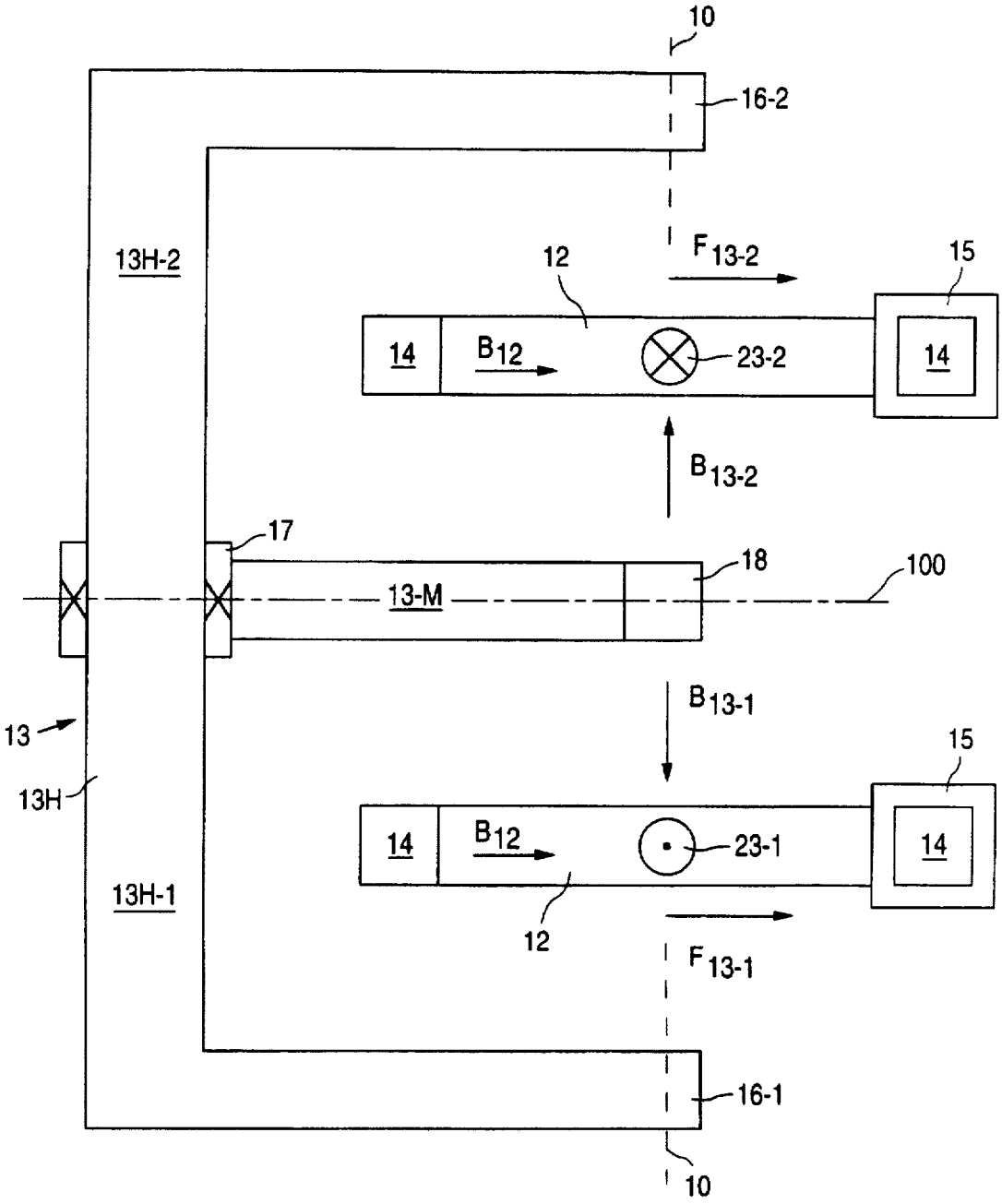
FIG. 4 is a bottom view of the magnetic system of the plasma generator of FIG. 1.
Figure 5:
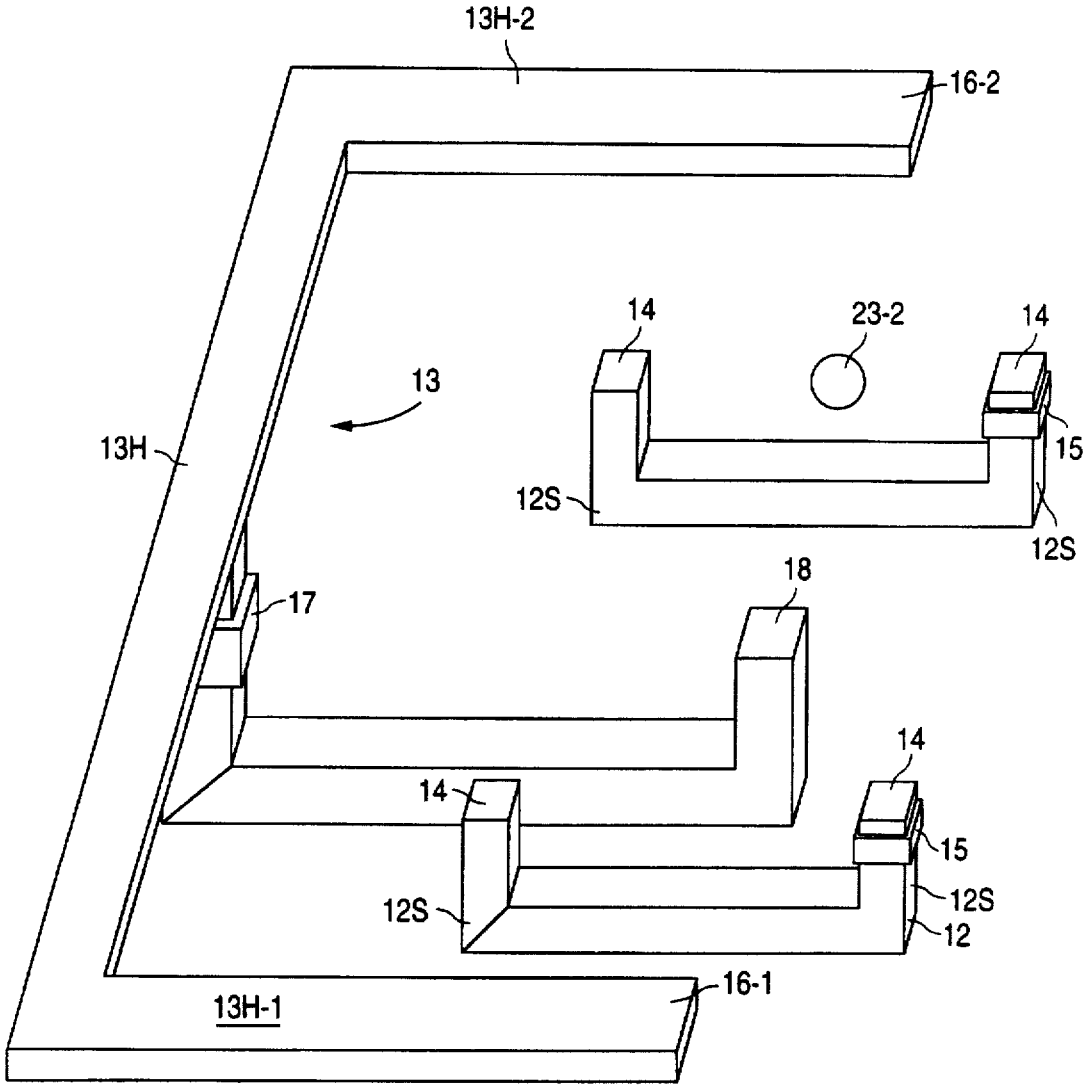
FIG. 5 is a perspective bottom view of the magnetic system of FIG. 4.

Plasma jets 23 are emitted from orifices 4 in the direction of respective axes 8. The plasma jets can be deflected by a magnetic system. Bottom views of the magnetic system are provided in FIGS. 4 and 5. The magnetic system includes one main magnetic circuit 12 for each electrode unit 1. Each circuit 12 can move its respective plasma jet 23-1 or 23-2 in a direction parallel to basic plane 10 towards or away from the other plasma jet 23. Each circuit 12 is a ferromagnetic member shaped as three sides of a rectangle. The two side legs 12S of every main magnetic circuit 12 are symmetric with respect to basic plane 10. In some embodiments, the two poles 14 at the two ends of each circuit 12 are symmetric with respect to the corresponding axis 8. In other embodiments, the poles 14 are not symmetric with respect to axis 8.

At least one electrical coil 15 is wound around each circuit 12.

A magnetic circuit 13 can move plasma jets 23 in a direction perpendicular to basic plane 10. Circuit 13 includes a horizontal member 13H (FIGS. 4, 5) shaped as three sides of a rectangle. One half 13H-1 of horizontal member 13H (the bottom half in FIGS. 4 and 5) forms a leg that ends in pole 16-1. The other half 13H-2 forms a leg that ends in pole 16-2. A middle leg 13M of circuit 13 extends from the middle of member 13H down in the view of FIG. 5, then horizontally, and then partially back up, and ends at pole 18 directly below the middle of the line interconnecting the poles 16. Coil 17 is wound around the middle leg 13M.

Pole 18 of circuit 13 is positioned on the device axis 9 between the following two points: point 19 (FIG. 1) of the intersection of the two axes 8 with device axis 9, and point 20 of intersection of the device axis 9 with the lines lying in the basic plane 10 and perpendicular to corresponding axes 8 and passing through the corresponding outlet orifices 4.

In some embodiments, poles 16-1 and 18 are symmetric with respect to axis 8 of electrode unit 1-1, and poles 16-2 and 18 are symmetric with respect to axis 8 of electrode unit 1-2. Poles 16-1, 18, 16-2 are positioned along basic plane 10. In some embodiments, poles 16-1, 18, 16-2 lie in basic plane 10.

In some embodiments, the plasma generator is provided with injection tube 21 (FIGS. 2, 3) affixed to base 2 and extending along axis 9. The distance between injection tube 21 and the point 19 of the intersection of the two axes 8 and device axis 9 is chosen to avoid thermal damage of injection tube 21 by plasma heat during operation. This distance is 10–50 mm in some embodiments. The end of injection tube 21 has one or more output holes 22 (FIG. 3) facing the point 19 and located along a plane perpendicular to basic plane 10.

The plasma generator is symmetric with respect to plane 100 (FIGS. 2, 4) passing through axis 9 and perpendicular to basic plane 10.

The plasma generator is operated as follows. The plasma generator is placed in a chamber (not shown) filled with air or some other gas. The pressure in the chamber is set at about 1/10 atm to 1 atm or higher. A gas to be ionized, which is argon in some embodiments, is delivered into every electrode unit 1 through gas inlets 5, as shown by arrow A (FIG. 1) for unit 1-2. A DC electrical discharge with a current I is ignited between the electrodes 6 by DC power supply 11. The angle a and the distance between electrode units 1 are chosen to provide stable electrical discharge for a given DC power supply 11. In some embodiments, the power supply voltage is 100–200 V; the distance between electrode units 1 (between the centers of orifices 4) is 20–100 mm, and the angle α is 30°–50°.

Plasma jets 23 meet in mix zone 24 and form combined plasma flow 25 which flows along axis 9.

Electrical current through coils 15 of magnetic circuits 12 creates magnetic fields $B_{12}$ (FIG. 4) between the poles 14 of every magnetic circuit 12. The magnetic inductance vectors $B_{12}$ are perpendicular to the basic plane 10. Magnetic fields $B_{12}$ interact with the electrical current I in plasma jets 23 to generate forces acting on plasma jets 23. These forces are parallel to basic plane 10. These forces allow deflecting the plasma jets 23 in a direction parallel to basic plane 10. Thus the angle between plasma jets 23 in the mixing zone 24 is controlled by controlling the electrical current in coils 15 without mechanical movement of electrode units 1. The angle between jets 23 can be greater than 90°, smaller than 90°, or equal to 90°.

The electrical current in coil 17 of magnetic circuit 13 creates: (1) magnetic field $B_{13-1}$ (FIG. 4) between the poles 16-1 and 18, and (2) magnetic field $B_{13-2}$ between the poles 16-2 and 18. The inductance vectors of these magnetic fields are parallel to basic plane 10 and have opposite directions from each other. Fields $B_{13-1}$, $B_{13-2}$ interact with current I in corresponding plasma jets 23-1, 23-2. Th e resulting forces $F_{13-1}$, $F_{13-2}$ acting on respective plasma jets 23-1, 23-2 are perpendicular to the basic plane. If magnetic fields $B_{12}$ are equal to each other, then the plasma jets 23 are symmetric with respect to plane 100. In this case the forces $F_{13-1}$, $F_{13-2}$ are equal t o each other. Therefore, the two plasma jets move perpendicularly to basic plane 10 in the same direction and by the same amount. Hence, plasma jets 23 meet and do not diverge.

Deviation of plasma jets 23 from basic plane 10 is control led by the current in coil 17.

The currents in coils 15 and 17 can be controlled independently from one another. Therefore, magnetic fields $B_{12}$ are independent from one another, and magnetic fields $B_{13-1}$, $B_{13-2}$ are independent from fields $B_{12}$. Consequently, simple and flexible control of plasma jets 23 is provided. The plasma jets can be controlled within a wide range of positions. The magnetic fields $B_{12}$, $B_{13}$ can be made as large as needed to control the plasma jets. Further, the current in each of coils 15, 17 affects only one of fields $B_{12}$ or only a pair of fields $B_{13-1}$, $B_{13-2}$, and does not affect other magnetic fields. Therefore, the current in each coil is easy to calculate.

A substance (for example, gas, vapor, aerosol, powder, etc.) is injected into the mix zone 24 through injection tube 21 along plasma generator axis 9, as shown by arrow C in FIG. 3. The substance is surrounded by overlapping plasma jets 23 combining into plasma flow 25. The substance is effectively heated in the central region of the combined plasma flow 25.

In some embodiments, the electric current in coil 17 of magnetic circuit 13 is an alternating current. Hence, plasma jets 23 and combined flow 25 oscillate synchronously in phase with each other in the direction perpendicular to basic plane 10. The oscillation frequency is the frequency of the alternating current in coil 17. The plasma oscillations virtually widen the plasma flow 25. These oscillations permit widening of the flow of the injected substance because the widened flow 25 can surround and heat a wider flow of the injected substance. In some embodiments, the flow of the injected substance is a fan-like flow widening downstream towards mix zone 24. In some embodiments, the flow of the injected substance has a larger cross section perpendicular to axis 9 than plasma flow 25, but a smaller cross section than the amplitude of oscillations of flow 25.

In some embodiments, the oscillation frequency of plasma flow 25 is chosen to be greater than $1/\tau$, where $\tau=l/v$ is the time that the injected substance travels in flow 25 at a speed v, and l is the length that the substance travels in flow 25. Given such frequency, the plasma flow 25 scans the injected substance at least once. In some embodiments, the frequency f is above 100 Hz. In some embodiments, f is between 400 Hz and 1000 Hz inclusive.

In FIG. 6, magnetic circuit 13 includes an additional coil **17*a* on leg 13H-2. The current through coil 17*a* generates additional magnetic field $B_{13a}$ between the middle pole 18 and the pole 16-2. Field $B_{13a}$ is used to compensate for possible asymmetry between plasma jets 23-1, 23-2. The asymmetry could be caused by faulty assembly of the plasma generator. For example, electrode nodes 1 could be positioned so that their axes 8 would not intersect or do not lie in one plane with axis 9. The asymmetry could also be caused by changes in operating conditions that would cause the plasma jets 23** to deviate from their symmetric position.

To set the current in coil **17*a*, the current in coil 17 is turned off while the current in coil 17*a* is adjusted to cause the plasma jets 23-1, 23-2 to meet at a suitable point, for example at the intersection 19 (FIG. 1) of axes 8 and 9. Then the plasma generator is operated like the generator of FIGS. 1–5 while the current in coil 17*a* is kept constant. If the current in coil 17 moves plasma jets 23, the plasma jets 23 continue to meet. Of note, in some embodiments, magnetic fields $B_{13-1}$, $B_{13-2}$, $B_{13a}$ are uniform over the range of motion of plasma jets 23. In particular, in some embodiments, the width $l_1$ (FIG. 6) of pole 18 in the direction perpendicular to magnetic fields $B_{13-1}$, $B_{13-2}$, $B_{13a}$ is larger than the amplitude of oscillations of plasma jets 23**. In some embodiments, the width $l_1$ is a few centimeters, and the oscillation amplitude is a few millimeter.

In some embodiments, coil **17*a* is located on leg 13H-1 rather than 13H-2**.

In FIG. 7, coil 17 is omitted. Instead, coils **17*a*, 17*b* are provided on respective legs 13H-2, 13H-1. The current in coil 17*a* controls plasma jet 23-2. The current in coil 17*b* controls plasma jet 23-1. Coils 17*a*, 17*b* allow controlling respective plasma jets 23-2, 23-1 independently from one another. In some embodiments, coils 17*a*, 17*b* have the same number of turns. The difference between the currents in coils 17*a*, 17*b* is preset to compensate for possible asymmetry of plasma jets 23-1, 23-2**. Therefore, a predetermined phase difference is created between the plasma jets. If oscillation of the plasma jets is desired, the currents in the two coils are varied by the same value to cause the plasma jets to move synchronously.

The coils in FIGS. 6 and 7 are suitable for applications highly sensitive to deviations of plasma jets 23 from their symmetric position. In applications less sensitive to such deviations, a single coil 17 (FIG. 4) may be sufficient.

In FIG. 8, magnetic circuit 13 is flat. Middle leg 13M is in the same plane as horizontal member 13H. Coil 17 is placed on middle leg 13M. In some embodiments, coil 17 is complemented by a coil **17*a*, or replaced by coils 17*a* and 17*b*, as described above in connection with FIGS. 6 and 7**.

Some embodiments include a feedback control system to control the plasma jets. Sensors (not shown) sense the position of plasma jets 23 and/or plasma flow 25. Signals generated by the sensors control the current in coils 15, 17, **17*a*, 17*b***. Such feedback control systems can be built by known methods. See the two articles by Yu. M. Agrikov et al., "Osnovy Realizatsii Metoda Dinamicheskoy Plazmennoy Obrabotki Poverhnosti Tverdogo Tela", Institut Neftehimicheskogo Sinteza im. A. V. Topchieva, Plazmohimiya-87 (USSR, 1987), part 2, at pp. 58–78 and 78–96, incorporated herein by reference. See also O. Yu. Budnik et al., "Apparatura Monitoringa Plazmennogo Potoka", Nauchno-Proizvodstvennoe Ob'edinenie "ROTOR", Oborudovanie Dlya Vysokoeffectivtnyh Tehnologiy", Nauchnye Trudy (Cherkassy, 1990), vol. 1, pp. 72–78 incorporated herein by reference.

In some applications, the plasma carrying gas is argon. The argon consumption in each electrode unit 1 is 1/10 to 1 liters per minute. The DC voltage between terminals 11 is 100–200 V. The plasma current flowing through a pair of jets 23 is 50–300 A. The angle α between each axis 8 and plasma generator axis 9 is 30°–50°. The distance between poles 14 of each circuit 12 is 3–6 cm. Each of magnetic fields $B_{12}$, $B_{13}$ is 10–50 gauss. The oscillation frequency of jets 23 is 0–1 KHz.

The plasma generators of FIG. 1–8 are suitable for many plasma processing applications. Some embodiments of the plasma generators are used for deposition and/or etch of materials in fabrication of semiconductor circuits. In particular, some embodiments are used for wafer and die back-side etches described in U.S. provisional patent application Ser No. 60/030,425 filed on Oct. 29, 1996 by Oleg V. Siniaguine, entitled "Back-Side-Contact Pads", incorporated herein by reference.

Some plasma generators are used to synthesize superfine powders (powders having a grain size of a few micrometers).

The above embodiments illustrate but do not limit the invention. The invention is not limited by any particular shape of magnetic circuits 12 or 13 or legs 13H-1, 13H-2, 13M, or by the number of magnetic circuits 12 and 13. Nor is the invention limited by the number of electrode units, the geometry of the units or magnetic circuits, symmetry of any parts or positions, or the number of electric coils associated with the magnetic circuits. Some embodiments include more than one pair of electrode units 1. The units of each pair are positioned opposite to each other around the plasma generator axis 9. For each pair of electrode units, a pair of magnetic circuits 12 and a magnetic circuit 13 control the direction of the plasma jets emitted by the units. Magnetic circuits 12 can move the two plasma jets towards or away from each other, and the magnetic circuit 13 can move the two plasma jets perpendicularly to the basic plane passing through the axes 8 of the two units. In some embodiments, different axes 8 form different angles with the axis 9 of combined plasma flow 25. In some embodiments, one of the two magnetic circuits 12 is omitted. Other embodiments and variations are within the scope of the invention, as defined by the following claims.

I claim:

1. A plasma generator comprising:

a first electrode unit for generating a first plasma flow;

a second electrode unit for generating a second plasma flow meeting the first plasma flow;

a first magnetic field generator for generating a first magnetic field for moving the first plasma flow in a first direction towards or away from the second plasma flow; and a second magnetic field generator for moving the first and second plasma flows in a direction transverse to the first direction, wherein a magnetic field generated by the second generator to move the first plasma flow is controllable independently of the first magnetic field.

2. The plasma generator of claim 1 further comprising a magnetic field generator for moving the second plasma flow towards or away from the first plasma flow.

3. The plasma generator of claim 1 wherein the second magnetic field generator comprises a magnetic circuit having a first pole, a second pole and a third pole, wherein the second magnetic field generator is for generating a magnetic field passing through the first and third poles and intersecting the first plasma flow, and wherein the second magnetic field generator is for generating a magnetic field passing through the second and third poles and intersecting the second plasma flow.

4. The plasma generator of claim 3 wherein the second magnetic field generator comprises a magnetic circuit having first, second and third extensions contiguous with each other, wherein the first pole is an end of the first extension, the second pole is an end of the second extension, and the third pole is an end of the third extension.

5. The plasma generator of claim 4 further comprising a conductive coil wound around the third extension.

6. The plasma generator of claim 4 further comprising a conductive coil wound around the first extension.

7. The plasma generator of claim 4 further comprising a conductive coil wound around the first extension and a conductive coil wound around the second extension.

8. The plasma generator of claim 1 further comprising an injection tube located between the first and second electrode units for injecting a substance into plasma.

9. The plasma generator of claim 8 wherein the injection tube has a plurality of holes through which the substance is to be injected from the tube into the plasma, wherein the holes extend along a plane perpendicular to a plane containing axes along which the electrode units are to emit the plasma.

10. A plasma generator comprising:

a first electrode unit for emitting a first plasma flow along a first axis;

a second electrode unit for emitting a second plasma flow along a second axis at an angle to the first axis;

a first magnetic circuit having two poles on opposite sides of a region containing the first and second axes; and a second magnetic circuit having first, second, and third poles positioned along said region, for generating a first magnetic field passing through the first and third poles and for generating a second magnetic field passing through the second and third poles, such that the first magnetic field intersects the first axis and the second magnetic field intersects the second axis.

11. The plasma generator of claim 10 wherein said region comprises a plane containing the first, second and third poles.

12. The plasma generator of claim 10 wherein the first magnetic circuit is for generating a magnetic field intersecting the first axis, and wherein the plasma generator further comprises a magnetic circuit having two poles on opposite sides of said region for generating a magnetic field intersecting the second axis.

13. A method for generating plasma, the method comprising:

emitting first and second gas flows at an angle to each other;

creating an electric discharge through the first and second gas flows;

generating a magnetic field B1 intersecting the first gas flow, to control the angle at which the first and second gas flows meet;

generating a first magnetic field intersecting the first gas flow and a second magnetic field intersecting the second gas flow, wherein the first magnetic field is transverse to the field B1, and wherein the first and second magnetic fields are controlled independently from the field B1.

14. The method of claim 13 further comprising generating a magnetic field B2 intersecting the second gas flow, wherein the second magnetic field is transverse to the field B2.

15. The method of claim 14 wherein the first and second magnetic fields are controlled independently from the field B2.

16. The method of claim 13 further comprising, generating a third magnetic field passing through the first and third poles to cause the first and second gas flows to meet.

17. The method of claim 13 further comprising varying the first and second magnetic fields to cause the first and second gas flows to oscillate.

18. The method of claim 17 wherein the first and second gas flows meet and form a combined flow which oscillates with the first and second gas flows.

19. The method of claim 17 wherein the first and second magnetic fields are equal in magnitude.

20. The method of claim 17 wherein a predetermined offset exists between magnitudes of the first and second magnetic fields.

* * * * *